United States Patent [19]

Watanabe et al.

[11] Patent Number: 4,648,480

[45] Date of Patent: Mar. 10, 1987

[54] CONDENSER MICROPHONE HAVING RESISTANCE AGAINST HIGH-TEMPERATURE AND RADIOACTIVE RAYS

[75] Inventors: Kenshu Watanabe; Kiminori Shiba, both of Mito; Mikiya Arai; Masaya Yamaguchi, both of Yokohama; Yasuo Fujiki, Fujisawa; Ryohei Fujimoto, Kamakura, all of Japan

[73] Assignee: Doryokuro Kakunenryo Kaihatsu Jigyodan, Tokyo, Japan

[21] Appl. No.: 766,433

[22] Filed: Aug. 16, 1985

[30] Foreign Application Priority Data

Sep. 10, 1984 [JP] Japan ..... 59-188032

[51] Int. Cl.[4] ..... H04R 7/00

[52] U.S. Cl. ..... 181/158; 381/174;189

[58] Field of Search ..... 181/149, 158, 175, 157; 179/106, 179

[56] References Cited

U.S. PATENT DOCUMENTS 3,190,972 6/1965 Schoeps et al. ..... 181/158 X 3,240,883 3/1966 Seeler ..... 181/158 X

*Primary Examiner*—Benjamin R. Fuller

*Attorney, Agent, or Firm*—Wenderoth, Lind & Ponack

[57] ABSTRACT

A condenser microphone utilizable at high temperature and intense radioactive rays. The microphone has a tension ring and a backplate, both of which are made of a metal having a small coefficient of linear expansion relative to the other parts of the microphone. The tension ring is fitted to a tension ring holder, and the backplate is mounted on the tension ring holder through an insulating material so that the tension ring and the backplate are held together to form a unitary structure.

6 Claims, 1 Drawing Figure

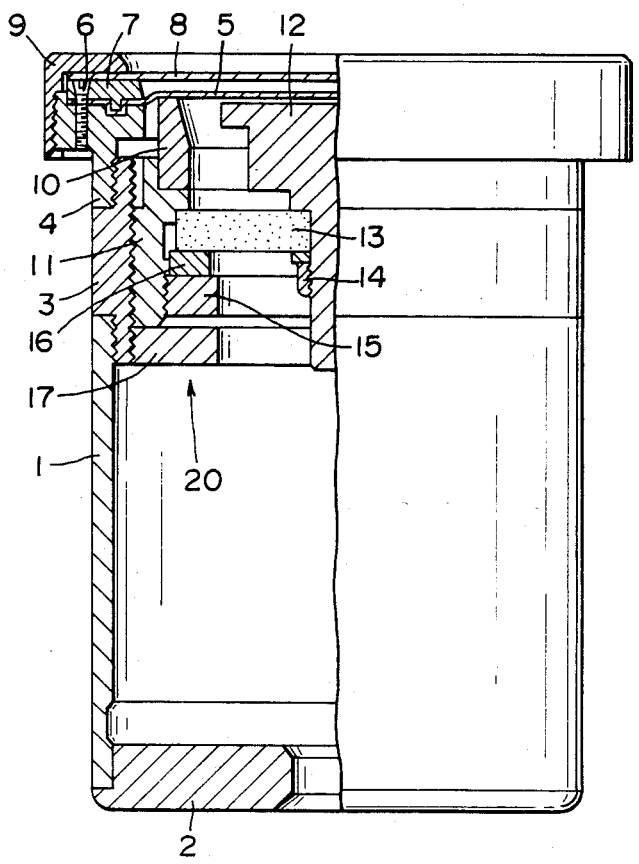
9
6
7
8
5
12
10
4
11
3
16
17
1
13
14
15
20
2

CONDENSER MICROPHONE HAVING RESISTANCE AGAINST HIGH-TEMPERATURE AND RADIOACTIVE RAYS

BACKGROUND OF THE INVENTION

The present invention relates to a condenser microphone having resistance against high temperatures and radioactive rays, which is highly sensitive and which exhibits good frequency characteristics at high temperatures and in the presence of intense radioactive rays.

Microphones are used not only in the audio world but also in industrial fields as sensors in order to convert vibration into electric signals. Many of them are used at ordinary temperature. However, microphones of the piezo-electric ceramic type are used at high temperatures, for example, in a high-temperature coolant (liquid sodium heated to about 700° C.) placed under intense radioactive rays ($10^7$ R) in a nuclear reactor.

The microphone of the piezo-electric ceramic type, however, has a sensitivity of as low as −105 to −120 dB under the conditions of a high-temperature atmosphere. Therefore, the microphone of the piezo-electric ceramic type is not capable of detecting sound of small levels when it is used in a high-temperature atmosphere condition. Microphones of other types are not utilizable at high temperatures as a matter of course. Therefore, the conventional microphones are not capable of detecting sound of small levels when they are used as sensors under high-temperature atmosphere conditions.

SUMMARY OF THE INVENTION

An object of the present invention is to solve the above-mentioned problems inherent to the conventional art.

Another object of the present invention is to provide an improved condenser microphone which can be used under the conditions of high temperature and radioactive rays.

Another object of the present invention is to provide an improved microphone which is capable of detecting sound of small levels under the condition of high temperature.

According to the present invention, there is provided a condenser microphone having resistance against high temperature and radioactive rays.

The microphone has a first cylindrical body having a bottom end member at its one end, a second cylindrical body threadedly engaged at its one end to the other end of the first cylindrical body, ring means threadedly engaged with the other end of the second cylindrical body, a vibration membrane fixed at its circumferential end to the ring means, and microphone structural body threadedly engaged with an inner surface of the second cylindrical body. The microphone structural body has tension means for imparting a tension to the vibration membrane, a backplate which has an upper surface spaced from the vibration membrane, and an insulator between the tension means and the backplate so that a unitary structure of the microphone structural body is formed. In the present invention, the tension means and the backplate are made of a metal having a small coefficient of linear expansion relative to the other elements such as the ring means and first and second cylindrical bodies.

In an embodiment of the invention, the tension means has a tension ring contacted with the vibration membrane, and a holder for holding the tension ring. The holder is threadedly engaged with the second cylindrical body and connected to the backplate through the insulator. Preferably, the insulator is a glass insulator of aluminosilicate. In a further embodiment of the invention, the ring means has a first ring threadedly engaged with the aforementioned second cylindrical body and a second ring fixed to the first ring with the circumferential end of the vibration membrane being secured firmly therebetween. In a further preferred embodiment of the invention, the height from the upper end of the insulator to the upper end of the backplate is set smaller by about 40 to 50 μm than the height from the upper end of the insulator to the upper end of the tension ring so that a gap of about 40 to 50 μm is maintained between the vibration membrane and the backplate when a tension is imparted to the membrane by the tension ring.

BRIEF DESCRIPTION OF THE DRAWING

The drawing is a partially cut-away side view of a condenser microphone embodying the present invention.

PREFERRED EMBODIMENT OF THE INVENTION

The present invention will be described with reference to the drawing which shows an embodiment of the invention.

In the drawing, reference numeral 1 denotes a microphone body which is cylindrical as illustrated, 2 denotes a bottom cover fitted to an end of the microphone body 1, and numeral 3 denotes a tube screwed into the inner surface of the other end of the microphone body 1. A first ring 4 is screwed onto the outer peripheral surface at an end of the tube 3. A vibration membrane 5 is fitted to the first ring 4 by screws 6. A second ring 7 is fitted to the first ring 4 with a circumferential end of the vibraiton membrane 5 being firmly held between the two rings 4 and 7. On the second ring 7, a front grid 8 is placed. A grid-fastening ring 9 is screwed onto the outer peripheral surface of the first ring 4 and fastens the front grid 8 to the second ring 7. Reference numeral 20 generally represents a microphone structural body, which has a tension ring 10 imparting a tension to the vibration membrane 5, a tension ring holder 11, a backplate 12 and a glass insulator 13. The tension ring holder 11 is screwed into the inner peripheral surface of the tube 3. The tension ring holder 11 holds the tension ring 10 directly and the backplate 12 through the glass insulator 13.

The backplate 12 is mounted on the glass insulator 13 by a nut 14, and the glass insulator 13 is fastened to the tension ring holder 11 through an intermediate insulating washer 16 by an insulator-fastening ring 15 that is screwed into the inner peripheral surface of the tension ring holder 11. The tension ring 10 and backplate 12 are made of a metal having a small coefficient of linear expansion such as, for example, titanium having a coefficient of linear expansion of $9.5\times10^{-6}$. Other parts such as elements 1, 3 and 4, except the electrically insulating parts such as glass insulator 13 and the like, are made of a metal having a coefficient of linear expansion larger than that of the above metal, e.g., made of a stainless steel having a coefficient of linear expansion of $17.3\times10^{-6}$. The insulators such as glass insulator 13 and the like will be made of, for example, an aluminosilicate glass.

Titanium, stainless steel and glass insulator can be used even in the presence of an intense radioactive rays ($10^7$ R).

The height from the upper surface of glass insulator 13 to the upper end of backplate 12 is smaller by 40 to 50 μm than the height from the upper surface of glass insulator 13 to the upper end of tension ring 10. Therefore, a gap of 40 to 50 μm is maintained between the vibration membrane 5 and the backplate 12 when the vibration membrane 5 is pushed by the tension ring 10 upward above the level where the circumferential end of the vibration membrane 5 is secured, and tension is imparted to the vibration membrane 5.

The tension ring 10 and backplate 12 are held together by the tension ring holder 11 through the glass insulator 13 to form a unitary structure. Therefore, if the tension ring holder 11 is moved up and down, the tension ring 10 and backplate 12 move up and down as a unitary structure, and tension of the vibration membrane 5 changes. However, the gap of 40 to 50 μm is maintained at all times between the vibration membrane 5 and the backplate 12.

After the desired tension is obtained by adjusting the tension ring holder 11, a tension-securing ring 17 is screwed into the inner peripheral surface of the tube 3 in order to lock the tension ring holder 11.

An operation will be explained with reference again to the drawing. All parts and members expand as temperature rises. The vibration membrane 5 also expands in the radial direction and in the lenghwise or axial direction of the cylindrical microphone body 1, as a matter of course. However, thickness of the vibration membrane 5 is very small compared with the length thereof in the radial direction. Therefore, expansion of the vibration membrane 5 itself in the lengthwise direction of the cylinder can be neglected. Here, the first ring 4 fastening the vibration membrane 5 is displaced in the lengthwise direction of the cylinder as it is expanded, and the vibration membrane 5 fastened to the upper surface of the first ring 4 is displaced in the lengthwise direction of the cylinder.

The tension ring 10 pushes the vibration membrane 5 upwardly beyond the upper surface of the first ring 4 which fastens the vibration membrane 5 so that a predetermined tension is imparted on the vibration membrane 5, and the tension ring 10 is positioned higher than the first ring 4 by the amount it pushes the vibration membrane upwards.

Provided that the tension ring 10 is made of the same material as the first ring 4 which fastens the vibration membrane, they expand in a similar manner though they may have different lengths. Therefore, the tension ring 10 and the first ring 4 are displaced equally with the rise in temperature, and the tension of the vibration membrane 5 remains the same irrespective of the change in temperature. Due to creep, however, the vibration membrane 5 expands by an increased amount with the rise in temperature and with the lapse of time.

According to the present invention, on the other hand, the tension ring 10 is made of a metal having a coefficient of linear expansion which is smaller than that of the first ring 4 for fastening the vibration membrane 5. Therefore, these two members do not expand in a similar manner the tension ring 10 expands with the rise in temperature in the lengthwise direction of the cylindrical microphone body 1, in an amount smaller than that of the first ring 4 which fastens the vibration membrane 5. Therefore, the tension ring 10 imparts less tension to the vibration membrane 5 than that at ordinary temperatures. Namely, less tension is imparted to the vibration membrane 5 than that of when the tension ring 10 and the first ring 4 for fastening the vibration membrane 5 are made of the same material; hence, the vibration membrane 5 expands by a small amount due to the creep that results from the rise of temperature.

According to the present invention, the effect of creep is extremely small at high temperatures. Therefore, the tension at ordinary temperatures is restored when the condition in which the microphone is used is changed from high temperatures to ordinary temperatures.

The backplate 12 is made of the same material as the tension ring 10, and is fitted to the tension ring 10 via the tension ring holder 11 as a unitary structure; hence, it is displaced like the tension ring 10. Even when the temperature rises, therefore, the gap changes very little between the vibration membrane 5 and the backplate 12.

According to the present invention, the tension imparted to the vibration membrane decreases as the temperature rises, and the effect of creep is restrained. Further, the gap changes very little between the vibration membrane and the backplate Accordingly, there is obtained a microphone which is highly sensitive and which exhibits good frequency characteristics under the conditions of high temperatures and intense radioactive rays. At a temperature of 300° C., for instance, the microphone exhibits a sensitivity of $-74\pm3$ dB, and frequency characteristics of $\pm5$ dB over a range of 500 to 10 KHz. Therefore, the present invention makes it possible to detect low amplitude sounds that could not be detected so far under high temperature atmosphere conditions.

While the invention has been described with respect to a preferred embodiment, it should be apparent to those skilled in the art that numerous modifications may be made thereto without departing from the spirit and scope of the invention.

What is claimed is:

1. A condenser microphone having resistance against high temperature and radioactive rays, comprising:

a. first cylindrical body having a bottom end member at its one end, b. second cylindrical body threadedly engaged at its one end to an other end of said first cylindrical body, c. ring means threadedly engaged with an other end of said second cylindrical body, d. a vibration membrane fixed at its circumferential end to said ring means, e. microphone structural body threadedly engaged with an inner surface of said second cylindrical body, wherein said microphone structural body comprises:

tension means for imparting a tension to said vibration membrane, a backplate having an upper surface spaced from said vibration membrane, a glass insulator between said tension means and said backplate to thereby form a unitary structure of said microphone structural body, and wherein said tension means and said backplate are made of a metal having a small coefficient of linear expansion relative to said ring means.

2. A microphone according to claim 1, wherein said tension means has a tension ring contacted with said vibration membrane, and a holder threadedly engaged with said second cylindrical body and holding said tension ring, said holder being connected to said backplate through said glass insulator.

3. A microphone according to claim 1, wherein said ring means has a first ring threadedly engaged with said second cylindrical body, and a second ring connected to said first ring with said circumferential end of the vibration membrane being held therebetween.

4. A microphone according to claim 1, wherein said tension means and said backplate are made of titanium having a coefficient of linear expansion of $9.5\times10^{-6}$.

5. A microphone according to claim 1, wherein said glass insulator is made of aluminosilicate glass.

6. A microphone according to claim 2, wherein a height from an upper surface of said glass insulator to an upper end of said backplate is smaller by about 40 to 50 μm than a height from the upper surface of said glass insulator to an upper end of said tension ring, so that a gap of about 40 to 50 μm is maintained between said vibration membrane and said backplate when said vibration membrane is pushed upward by said tension ring above a level where said circumferential end of the vibration membrane is held.

* * * * *